US005541048A

United States Patent [19]

Whitesides et al.

[11] Patent Number: 5,541,048

[45] Date of Patent: Jul. 30, 1996

[54] LUBRICANT PARTICLES, METHOD OF PREPARATION, AND PHOTOGRAPHIC ELEMENTS

[75] Inventors: Thomas H. Whitesides, Rochester; Bonnie L. Howell, Middlesex; Ronda E. Factor, Rochester, all of N.Y.

[73] Assignee: Eastman Kodak Company, Rochester, N.Y.

[21] Appl. No.: 440,265

[22] Filed: May 12, 1995

[51] Int. Cl.[6] ..... G03L 1/00

[52] U.S. Cl. ..... 430/523; 430/17; 430/138; 430/607; 430/631; 430/640

[58] Field of Search ..... 430/631, 138, 430/607, 640, 17, 523

[56] References Cited

U.S. PATENT DOCUMENTS

| | | | |
|---|---|---|---|
| 2,454,043 | 11/1948 | Dimsdale et al. . | |
| 2,588,765 | 3/1952 | Robijns et al. . | |
| 2,732,305 | 1/1956 | Richman et al. . | |
| 2,976,148 | 3/1961 | Walford et al. . | |
| 3,042,222 | 7/1962 | Lehmann . | |
| 3,042,522 | 7/1962 | Ben-Ezra et al. . | |
| 3,053,662 | 9/1962 | Mackey et al. . | |
| 3,080,317 | 3/1963 | Tallet et al. . | |
| 3,121,060 | 2/1964 | Duane et al. . | |
| 3,206,311 | 9/1965 | Campbell et al. . | |
| 3,295,979 | 1/1967 | Secrist et al. . | |
| 3,489,567 | 1/1970 | McGraw et al. . | |
| 3,502,473 | 3/1970 | Snellman et al. . | |
| 3,933,516 | 1/1976 | Mackey . | |
| 4,004,927 | 1/1977 | Yamamoto et al. | 430/631 |
| 4,047,958 | 9/1977 | Yoneyama et al. . | |
| 4,268,623 | 5/1981 | Sera et al. . | |
| 4,427,964 | 1/1984 | Ruegsegger . | |
| 4,777,113 | 10/1988 | Inoue et al. . | |
| 4,914,012 | 4/1990 | Kawai . | |
| 4,995,995 | 2/1991 | Garvey et al. | 252/28 |
| 5,378,577 | 1/1995 | Smith et al. | 430/631 |

FOREIGN PATENT DOCUMENTS

| | | |
|---|---|---|
| 955061 | 4/1964 | United Kingdom . |
| 1065536 | 4/1967 | United Kingdom . |
| 1143118 | 2/1969 | United Kingdom . |
| 1198387 | 7/1970 | United Kingdom . |
| 1263722 | 2/1972 | United Kingdom . |
| 1270578 | 4/1972 | United Kingdom . |
| 1320565 | 6/1973 | United Kingdom . |
| 1320756 | 6/1973 | United Kingdom . |
| 1320757 | 6/1973 | United Kingdom . |
| 1430997 | 4/1976 | United Kingdom . |
| 1466304 | 3/1977 | United Kingdom . |

OTHER PUBLICATIONS

Research Disclosure No. 308, Dec. 1989, p. 1006.

*Primary Examiner*—Thorl Chea
*Attorney, Agent, or Firm*—Robert A. Gerlach

[57] ABSTRACT

This invention contemplates droplets of liquid lubricant, each droplet coated with colloidal particulate suspension stabilizing agent.

The invention also contemplates a method of making size stable lubricant droplets by forming a discontinuous phase of lubricant droplets in a continuous aqueous phase containing a particulate suspension stabilizing agent, reducing the size of the lubricant droplets and limiting the coalescence of the lubricant droplets by action of the particulate suspension stabilizing agent.

A third aspect of the invention is an imaging element comprising a support, at least one light-sensitive layer and a protective layer further removed from the support than the light-sensitive layer, at least one layer containing droplets of lubricant coated with colloidal particulate suspension stabilizing agent.

4 Claims, No Drawings

LUBRICANT PARTICLES, METHOD OF PREPARATION, AND PHOTOGRAPHIC ELEMENTS

BACKGROUND OF THE INVENTION

1. Field of the Invention

This invention relates to lubricant droplets, a process for the production of such droplets, to aqueous dispersions of water insoluble lubricant oils having uniform size distributions, and to photographic elements having enhanced lubricity, reduced friction, improved scratch resistance, and improved optical characteristics of the element.

2. Description of Related Art

Various lubricants have been employed in photographic film and papers products, especially in the outermost layer or layers of the element.

In copending U.S. application Ser. No., Docket No. 70170RAG, filed by Y. Wang, A. B. Fant, K. M. Schroeder, and G. W. Visconte, entitled "Photographic Element Having Improved Scratch Resistance" filed on even date herewith and assigned to the same assignee as this application, droplets of lubricant having a size relationship with respect to the thickness of the layer of a photographic element in which the droplets reside are disclosed. It is desired that the lubricating droplets have a narrow particle size distribution.

Because of the nature of liquid lubricant droplets, it is extremely difficult to obtain droplets that are stable over any length of time. Thus, it is readily apparent that it is even a more difficult problem to provide uniformly sized, stable lubricant droplets. It would be desirable to have a process for making stable lubricant droplets capable of being applied from a coating composition to form layers of uniformly sized lubricant droplets in a binder. Finally, it would be desirable to provide photographic elements having at least one layer containing uniformly sized and dispersed lubricant droplets.

SUMMARY OF THE INVENTION

This invention contemplates droplets of liquid lubricant, each droplet coated with colloidal particulate suspension stabilizing agent.

The invention also contemplates a method of making size stable lubricant droplets by forming a discontinuous phase of lubricant droplets in a continuous aqueous phase containing a particulate suspension stabilizing agent, reducing the size of the lubricant droplets and limiting the coalescence of the lubricant droplets by action of the particulate suspension stabilizing agent.

A third aspect of the invention is an imaging element comprising a support, at least one light-sensitive layer and a protective layer further removed from the support than the light-sensitive layer, at least one layer containing droplets of lubricant coated with colloidal particulate suspension stabilizing agent.

DESCRIPTION OF THE PREFERRED EMBODIMENTS

The control of the droplet size of lubricants is extremely difficult because of the nature of such materials to continuously coalesce into ever increasing size droplets until a single phase results. In the preparation of photographic elements containing a layer having therein lubricant droplets, it has been found that the size of the lubricant droplets and the uniformity of the droplets size is an important parameter with regard to the quality of the photographic image, and the scratch resistance of the photographic element when it comes in contact with other parts of the apparatus in which it is employed, such as, cameras, photo processes apparatus, and the like. A particular embodiment of this is set forth in previously mentioned copending U.S. Pat. application Ser. No.,(Docket 70,170).

The lubricant droplets as described herein are prepared by forming a discontinuous phase of lubricant droplets in a continuous aqueous phase containing a particulate suspension stabilizing agent, reducing the size of the lubricant droplets and limiting the coalescence of the droplets by the action of the particulate suspension stabilizing agent on the surface of the droplets.

In one embodiment, the lubricant droplets may be made by a limited coalescence process wherein the lubricant is dissolved in a suitable solvent therefor, which solvent is removed by evaporation after the size of the droplets have been established by limiting the coalescence thereof. In a second embodiment, a permanent solvent is mixed with the lubricant. This mixture is dispersed in an aqueous medium and the size of the droplets by limiting the coalescence by the action of the suspension stabilizing agent. The permanent solvent, which has a higher surface energy remains in the droplet, thus avoiding the evaporation step as in the procedure outlined above. Either of these methods give narrow particle size distribution with the mean particle size of the droplets being controlled by the amount of the particulate suspension stabilizing agent employed in the preparation of the dispersion. Thus, the particular lubricant employed is generally mixed with either the volatile solvent or with the permanent solvent and then dispersed in an aqueous medium containing the particulate suspension stabilizing agent and a promoter, the purpose of which is to drive the particulate suspension stabilizing agent to the interface between the lubricant droplet and the water medium. The dispersion of lubricant droplets in the aqueous medium is then vigorously mixed by any suitable device including high speed agitation, ultrasonic devices, homogenizers, and the like in order to reduce the particle size of the lubricant droplets to less than that ultimately desired. The presence of the particulate suspension stabilizer then controls the level of coalescence that takes place until an equilibrium is reached and the particle size does not grow any farther. In the preparation including the volatile solvent, the solvent can then be driven off by raising the temperature to above the volatilization temperature of the solvent. The droplets are then employed in the preparation of a coating composition for use in the preparation of an imaging element. In the case using a permanent solvent, the droplets including the permanent solvent are used directly in the preparation of the coating composition.

In order to provide suitable formulations for applying a layer containing the lubricant droplets in accordance with this invention for use in a photographic element, the dispersions prepared by either of the methods described above, are combined with a hydrophilic colloid, gelatin being the preferred material. It may be desirable to include surfactants with the lubricant dispersion prior to the addition of gelatin in order to prevent the removal of the particulate suspension stabilizing agent from the lubricant droplets. This aids in preventing further coalescence of the lubricant droplets.

There is no limitation on the types of lubricants for the practice of the present invention as long as they are liquid or can be dissolved or suspended in an appropriate liquid phase. Typical lubricants include (1) silicone based materials disclosed, for example, in U.S. Pat. Nos. 3,489,567, 3,080, 317, 3,042,522, 4,004,927, 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043, 2,732,305, 2,976,148, 3,206,311, 3,933,516, 2,588,765, 3,121,060, 3,502,473, 3,042,222 and 4,427,964, in British Patent Nos. 1,263,722, 1,198,387, 1,430,997, 1,466,304, 1,320,757, 1,320,565, and 1,320,756, and in German Patent Nos. 1,284,295 and 1,284, 294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethylene), poly(trifluorochloroethylene), poly(vinylidene fluoride, poly (trifluorochloroethylene-co-vinyl chloride), poly(meth)acrylates or poly(meth)acrylamides containing perfluoroalkyl side groups, and the like. Lubricants useful in the present invention are also described in further detail in *Research Disclosure* No. 308, December 1989, page 1006, all of the above incorporated herein by reference.

The above lubricants also may contain reactive functional groups such as hydroxyl, thiol, carboxyl, carbodiimide, epoxy, aziridine, vinyl sulfone, sulfinic acid, active methylene, amino, and amide. Typical examples of compounds useful for the present invention are shown below, but the present invention is not limited by these compounds:

Carnauba Wax, Michelube 160 [Michelman Inc.]

Paraffin Wax 112/118 AMP, m.p. =46.1° C. [Frank B. Ross Inc.]

Paraffin Wax 125/130 AMP, m.p. =53.3° C. [Frank B. Ross Inc.]

Paraffin Wax 140/145 AMP, m.p. =61.1° C. [Frank B. Ross Inc.]

Ross Wax 140, m.p. =137.8° C. [Frank B. Ross Inc.]

GP-218 silicone polyol copolymer [Genesee Polymers Co.]

GP-4 silicone fluid, amine functionalized [Genesee Polymers Co.]

GP-7100 amine functional paintable silicone fluid [Genesee Polymers Co.]

GP-7200 silicone fluid, mercapto functionalized [Genesee Polymers Co.]

EXP-58 silicone wax [Genesee Polymers Co.]

EXP-61 silicone wax, amine functionalized [Genesee Polymers Co.]

EXP-77 silicone wax, mercapto functionalized [Genesee Polymers Co.]

GP-7101 silicone copolymer [Genesee Polymers Co.]

BYK-331, polyether modified di-methylpolysiloxane copolymer [BYK Chemie]

BYK-371, reactive silicone additive, an acrylic functional, polyester-modified dimethylpolysiloxane [BYK Chemie]

DC-200 silicone fluid [Dow Corning Inc.]

PS099 dimethylsiloxane-bisphenol A carbonate block copolymer [Petrarch Inc.]

PS130 polymethyloctadecylsiloxane [Petrarch Inc.]

PS135 poly(methylhexadecyl siloxane) [Petrarch Inc.]

PS-464 polydimethylsiloxane, vinylphenylmethyl terminated [Petrarch Inc.]

Ethylene glycol distearate

Ethylene glycol monostearate

Lubracal 60, Calcium sterate

Glyceryl monostearate

Silicone oils are the preferred lubricant for practicing this invention. Polydimethyl siloxane, particularly DC200 made by Dow Corning, is most preferred.

As for the suspension stabilizing agents that surround the lubricating properties and which serve in the process of this invention to prevent the coalescence of the lubricant droplets, any suitable colloidal stabilizing agent known in the art of forming polymeric particles by the addition reaction of ethylenically unsaturated monomers by the limited coalescence technique can be employed such as, for example, inorganic materials such as, metal salt or hydroxides or oxides or clays, organic materials such as starches, sulfonated crosslinked organic homopolymers and resinous polymers as described, for example, in U.S. Pat. No. 2,932, 629; silica as described in U.S. Pat. No. 4,833,060; copolymers such as copoly(styrene-2-hydroxyethyl methacrylate-methacrylic acid-ethylene glycol dimethacrylate) as described in U.S. Pat. No. 4,965,131, all of which are incorporated herein by reference. Silica is the preferred suspension stabilizing agent for use in accordance with this invention.

Suitable promoters to drive the suspension stabilizing agent to the interface of the lubricant droplets and the aqueous phase include sulfonated polystyrenes, alginates, carboxymethyl cellulose, tetramethyl ammonium hydroxide or chloride, triethylphenyl ammonium hydroxide, triethylphenyl ammonium hydroxide, triethylphenyl ammonium chloride, diethylaminoethylmethacrylate, water-soluble complex resinous amine condensation products, such as the water soluble condensation product of diethanol amine and adipic acid, such as poly(adipic acid-co-methylaminoethanol), water soluble condensation products of ethylene oxide, urea, and formaldehyde and polyethyleneimine; gelatin, glue, casein, albumin, gluten, methoxycellulose, and the like. The preferred promoter for use in accordance with the invention is triethylphenyl ammonium chloride.

With regard to the first method of making the lubricant droplets in accordance with this invention, mentioned above, any suitable water-immiscible organic solvent with a boiling point less than that of water that can be readily removed from the lubricant droplets by evaporation may be employed, such as, for example, benzene, petroleum ether (bP<100° C.), pentane, hexane, heptane, octane, isomers thereof, volatile halogenated solvents, such as, methylene chloride, chloroform, carbon tetrachloride, methylethyl ketone, trichloroethylene, 1,1,1-trichloroethane, ethylenedichloride, and the like, volatile esters, such as methyl acetate, ethyl acetate, or ethyl formate, or ethers such as diethyl ether, and the like. Alkyl acetates are preferred.

With regard to the second method of preparation of the lubricant droplets in accordance with this invention, any suitable water-insoluble organic solvent having a boiling point substantially greater than water include aromatic esters such as methyl, ethyl, butyl, octyl or dodecyl benzoate, phthalates such as dimethyl, diethyl, dibutyl, dioctyl, or didodecyl phthalate, aliphatic esters such as octyl acetate, diethyl sebacate, bis(2-ethylhexyl)cyclohexanedimethanol, or butoxyethoxylethyl acetate, phosphate esters such as tritolylphosphate, trihexylphosphate, or trioctylphosphate, amides such as N,N-diethyllauramide or N,N-dibutyllauramide, alkanes with more than 8 carbons, such as decane, dodecane or hexadecane, phenols such as 2,5-di(t-amyl)phenol or 2-ethylhexyl p-hydroxybenzoate, ethers such as dioctylether or phenoxytoluene, or substituted aromatic compounds, such as trimethylbenzene, octylbenzene or tripropylnaphthalene, and the like.

In order to provide suitable coating compositions for applying a layer containing the lubricant droplets in accordance with this invention to a photographic element, such as, a protective layer being the outermost layer over the light-sensitive emulsion layers of a photographic element, the dispersion of the lubricant droplets in water is mixed with a suitable hydrophilic colloid in suitable proportions to achieve the coverage of lubricant droplets desired. The coating composition is then applied to the surface of the element to achieve a layer containing the coated lubricant droplets in the hydrophilic colloid.

In order to prevent the hydrophilic colloid from removing the suspension stabilizing agent from the surface of the lubricant droplets, suitable anionic surfactants may be included in the mixing step to prepare the coating composition such as polyisopropyl naphthalene-sodium sulfonate, sodium dodecyl sulfate, sodium dodecyl benzene sulfonate, as well as those anionic surfactants set forth in U.S. Pat. No. 5,326,687 and in Section XI of *Research Disclosure* 308119, December 1989, entitled "Photographic Silver Halide Emulsions, Preparations, Addenda, Processing, and Systems", both of which are incorporated herein by reference. Aromatic sulfonates are more preferred and polyisopropyl naphthalene sulfonate is most preferred.

Suitable hydrophilic binders include both naturally occurring substances such as proteins, protein derivatives, cellulose derivatives (e.g. cellulose esters), gelatins and gelatin derivatives, polysaccaharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl acrylate and methacrylates, vinyl imidazole copolymers, vinyl sulfide copolymers, homopolymer or copolymers containing styrene sulfonic acid, and the like. Gelatin is preferred.

The protective layer useful in the practice of the invention can be applied in any of a number of well-known techniques, such as dip coating, rod coating, blade coating, air knife coating, gravure coating and reverse roll coating, extrusion coating, slide coating, curtain coating, and the like. The lubricant particles and the binder are preferably mixed together in a liquid medium to form a coating composition. The liquid medium may be a medium such as water or other aqueous solutions in which the hydrophilic colloid are dispersed with or without the presence of surfactants.

Photographic elements in which the droplets of the invention can be utilized generally comprise at least one light-sensitive layer, such as silver halide emulsion layer. This layer may be sensitized to a particular spectrum of radiation with, for example, a sensitizing dye, as is known in the art. Additional light-sensitive layers may be sensitized to other portions of the spectrum. The light-sensitive layers may contain or have associated therewith dye-forming compounds or couplers. For example, a red-sensitive emulsion would generally have a cyan coupler associated therewith, a green-sensitive emulsion would be associated with a magenta coupler, and a blue-sensitive emulsion would be associated with a yellow coupler. Other layers and addenda, such as antistatic compositions, subbing layers, surfactants, filter dyes, protective layers, barrier layers, development inhibiting releasing comounds, and the like can be present in photographic elements of the invention, as is well-known in the art. Detailed description of photographic elements and their various layers and addenda can be found in the above-identified *Research Disclosure* 17643 and in James, *The Theory of the Photographic Process,* 4th, 1977.

Photographic elements suitable for use in combination with the protective layer containing lubricant droplets in accordance with this invention are disclosed in *Research Disclosure* 22534, January 1983, which is incorporated herein by reference. Further, the light-sensitive elements disclosed in U.S. Pat. No. 4,980,267 fully incorporated herein by reference are particularly applicable to protection by the overcoat layers in accordance with this invention.

It is, at times, desirable to include in the layer containing the lubricant droplets, in accordance with this invention, an amount of polymeric emulsion polymerized latex particles to improve adhesion during processing. Suitable polymeric latex particles have a diameter of from about 0.01 to 0.5 μm, preferably from about 0.02 to about 0.1 μm and are employed in an amount of from about 10 to about 75 weight percent, preferably from about 25 to about 50 percent by weight based on the weight of the gelatin present in the layer. Suitable monomers for use in the preparation of latex homopolymers or copolymers include, for example, methyl acrylate, methyl methacrylate, 2-acrylamido-2-methyl propane sulfonic acid, styrene, butyl methacrylate, 2-methacryloyloxyethyl-1-sulfonic acid-sodium salt, vinylidene chloride, itaconic acid, acrylonitrile, acrylic acid, n-butyl acrylate, 2[N,N,N-trimethyl ammonium]ethyl methacrylate methosulfate and the like. Particularly, suitable copolymers include polymethyl acrylate-co-2-acrylamido2-methylpropane sulfonic acid (96:4), styrene-co-butylmethacrylate-co-2-methacryloyloxy-ethyl-1-sulfonic acid-sodium salt, methyl acrylate-co-vinylidene chloride-co-itaconic acid, acrylonitrile-co-vinylidene chloride-co-acrylic acid, n-butyl acrylate-co-methylmethacrylate, acrylonitrile-co-vinylidene chloride-co-2[N,N,N,-bimethyl ammonium]ethyl methacrylate methosulfate and the like.

The invention is further illustrated by the following examples:

EXAMPLES 1–3

An oil phase was prepared consisting of 300.0 g Dow Corning Silicone Oil DC200 and 300.0 g ethyl acetate. A 24% suspension of colloidal silica in water was made from 46.2 g of Ludox TM (Dupont, 51.7% solids) and 53.8 g water. The promotor (triethylphenylammonium chloride) was used as a 6.0% solution in water. Three dispersions were prepared using the compositions listed in Table 1 below by mixing the ingredients, shaking vigorously to make a premix, and then homogenizing using a Microfluidics Microfluidizer operating at 8000 psig.

TABLE 1

| Example # | Oil Phase (g) | pH 4 VWR Buffer (g) | Ludox TM Stock (g) | Promotor Stock (g) |
|---|---|---|---|---|
| 1 | 180 | 405.3 | 13.3 | 1.5 |
| 2 | 180 | 390.8 | 26.3 | 3.0 |
| 3 | 180 | 361.5 | 52.5 | 6.0 |

After homogenization, 400.0 g of each dispersion was mixed with 400.0 g of 15% deionized Type IV gelatin in water at 45° C. in a 2 L round bottom flask, and ethyl acetate was removed using a rotating vacuum evaporator. The weight lost in the evaporation was replaced with water. The resulting disperions were sized using a Coulter Multisizer II, and had number mean sizes of 7.6, 4.6 and 2.7 μm for Examples 1, 2, and 3, respectively and contained about 7.2% DC200 and 7.5% gelatin.

EXAMPLES 4–7

An oil phase was prepared by combining 65.0 g of butoxyethoxyethyl acetate with 585.0 g of Dow Corning Silicone Oil DC200. A stock suspension of colloidal silica in pH 4 buffer was prepared by mixing 52.2 g of Ludox TM (51.7% solids) with buffer (VWR Scientific phthalate buffer) to a total weight of 215.0 g and then readjusting the pH to 4 by the dropwise addition of 12 M hydrochloric acid. Three dispersions of differing particle size were prepared from these stock solutions by combining them according to Table 2 below. A premix was prepared from each composition by stirring for 60 sec with a high shear mixer (Silverson LR4), and then homogenizing using a Microfluids Corporation Microfluidizer operating at 8000 psig.

TABLE 2

Compositions of Direct Dispersions

| Example # | Oil Phase (g) | Water (g) | Ludox TM Stock (g) | Promotor Stock (g) |
|---|---|---|---|---|
| 4 | 210.0 | 226.8 | 246.4 | 16.8 |
| 5 | 210.0 | 379.4 | 103.5 | 7.1 |
| 6 | 210.0 | 426.4 | 59.6 | 4.1 |
| 7 | 210.0 | 450.9 | 36.8 | 2.5 |

After homogenization, 500.0 g of each dispersion was treated with 80.0 g of 10% Alkanol XC (polyisopropyl naphthalene sulfonate, an anionic surfactant made by DuPont) in water and 420.0 g of additional water. To this mixture, for each dispersion, was added 1 kg of 15.0% deionized Type IV gelatin dissolved in water and melted at 45° C. During the gelatin addition, the dispersions were stirred with marine propellor stirrer at 450 rpm. The final dispersions had a composition corresponding to 6.74% DC200, 7.5% gelatin and 0.4% Alkanol XC. Analysis using a Coulter Multisizer II showed that the number average particle sizes of the dispersions were 1, 3.0, 5.3, and 8.4 μm for Examples 4, 5, 6, and 7 respectively. In all cases, 90% of the volume of the oil phase was contained in particles with sizes within a factor of about 1.5 of the modal diameter.

The lubricant droplet dispersions of Examples 1–6 give droplet sizes that are readily controlled by the amount of silica, and are relatively insensitive to the conditions of homogenization of the mixture. They are reproducible, easy to make on a large scale in a predictable manner and without increasing in size over long periods give stable, narrow particle size distributions.

What is claimed is:

1. An imaging element comprising at least one light-sensitive layer and at least one layer containing droplets of lubricant having a coating of colloidal particulate suspension stabilizing agent.

2. The imaging element of claim 1 wherein the layer containing droplets of lubricant includes a hydrophilic binder.

3. The imaging element of claim 1 wherein the hydrophilic binder is gelatin.

4. The imaging element of claim 1 wherein the light-sensitive layer contains silver halide.

* * * * *